US005890443A

United States Patent [19]

Taya et al.

[11] Patent Number: 5,890,443

[45] Date of Patent: Apr. 6, 1999

[54] VOLUME-REDUCING TREATMENT METHOD FOR WASTE

[75] Inventors: Sadao Taya, Ikoma; Masafumi Maeda, 5-26-1, Nobidome, Niiza-shi, Saitama, both of Japan

[73] Assignees: Kabushiki Kaisha Shinsei, Higashiosaka; Masafumi Maeda, Niiza, both of Japan

[21] Appl. No.: 563,819

[22] Filed: Nov. 28, 1995

[51] Int. Cl.[6] ..... F23G 7/00

[52] U.S. Cl. ..... 110/346; 423/60

[58] Field of Search ..... 110/109, 255, 110/346, 229; 423/60

[56] References Cited

U.S. PATENT DOCUMENTS

| | | | |
|---|---|---|---|
| 3,785,304 | 1/1974 | Stookey | 110/346 |
| 4,084,521 | 4/1978 | Herbold et al. | 110/346 X |
| 4,426,936 | 1/1984 | Kuo | 110/346 X |
| 4,469,034 | 9/1984 | Eriksson et al. | 110/346 |
| 5,086,716 | 2/1992 | Lafser, Jr. | 110/346 X |
| 5,185,134 | 2/1993 | Gullett | 110/346 X |
| 5,379,705 | 1/1995 | Takada et al. | 110/229 X |

*Primary Examiner*—Henry Bennett
*Assistant Examiner*—Susanne C. Tinker
*Attorney, Agent, or Firm*—Oblon, Spivak, McClelland, Maier & Neustadt, P.C.

[57] ABSTRACT

A low-cost volume-reducing treatment method for waste which thermally decomposes or burns chlorine-containing waste while the generation of hydrogen chloride and dioxin is completely or considerably suppressed. According to the method, volume of the waste can be greatly reduced. Shredder dust and other waste which contains chlorine derived from, for example, chlorine-containing polymers is thermally decomposed or burned at a temperature of 300° to 1000° C. in a reducing atmosphere where unburned carbon remains. Preferably, a basic material like red mud which contains alkali metal oxides or alkaline earth metal oxides is added before treatment.

19 Claims, 2 Drawing Sheets

VOLUME-REDUCING TREATMENT METHOD FOR WASTE

BACKGROUND OF THE INVENTION

1. Field of the Invention

The present invention relates to a volume-reducing treatment method for waste, such as shredder dust, which contains chlorine. In particular, the present invention relates to a low-cost waste treatment method which thermally decomposes or burns waste, such as shredder dust, which contains chlorine at relatively low temperatures in a reducing atmosphere, thereby completely or considerably suppressing the generation of hydrogen chloride and dioxin, obtaining a combustible gas, and greatly reducing volume.

2. Description of the Related Art

In conventional treatment methods for waste articles such as discarded automobiles and waste household electric appliances, the discarded articles are dismantled and recyclable parts are collected. Then, the remainder is torn into pieces by a shredder, and valuable metals are collected. Thus, a valueless mass is left as shredder dust. In actual practice, most of the shredder dust is disposed of in a reclamation yard without being burned. The shredder dust has a quite small bulk specific gravity, and the number of scrapped automobiles and the like is increasing. Accordingly, it is becoming difficult to find space for scrap yards where shredder dust is disposed of. In addition, in view of the fact that shredder dust contains inorganic matter, such as heavy metals, and chlorine in the form of a chlorine-containing polymer, such as a vinyl chloride resin and polychloroprene rubber, environmental regulations on scrap yards are tending to become stricter.

When shredder dust is burned, a great reduction in volume is attained, thereby facilitating its disposal. However, since the shredder dust has a high heat of combustion and contains chlorine-containing polymers, burning shredder dust involves the problems of corrosion of an incinerator caused by hydrogen chloride gas generated in combustion, and of the generation of dioxin.

Various techniques of incineration treatment for shredder dust and other waste which contains chlorine-containing polymers (and as a result which contains chlorine) are known. Japanese Patent Application Laid-open (kokai) No. 5-296429 discloses a fluidized-bed combustion apparatus wherein waste is burned in a low-oxygen atmosphere in a primary fluidized-bed, unburned solid matter is burned in a secondary fluidized-bed, a combustion exhaust gas is desulfurized and dechlorinated in a tertiary fluidized-bed, and the thus desulfurized and dechlorinated combustion exhaust gas is discharged. Japanese Patent Application Laid-open (kokai) No. 54-52873 discloses an incineration treatment method for vinyl chloride resins which involves spraying a basic calcium compound of 60-mesh or smaller particles preheated to a temperature of 200° to 300° C., over an object to be incinerated during incineration or thermal decomposition, so as to fix hydrogen chloride by reaction therewith. Japanese Patent Application Laid-open (kokai) No. 63-6313 discloses a combustion gas treatment method which involves subjecting an object to be incinerated to incomplete combustion in a dry distillation furnace, leading combustible gas which is generated into a secondary incinerator, and spraying an alkali agent such as calcium carbonate in the secondary incinerator so as to effectively remove harmful gases such as a hydrogen chloride gas or sulfur oxides. However, the conventional techniques described above carry out high-temperature oxidizing combustion on waste or a generated gas and add an exhaust gas treatment to the combustion treatment. That is, the conventional techniques are not intended to suppress the generation of harmful gases such as hydrogen chloride and dioxin during incineration and are not satisfactory because of both higher equipment costs and treatment and insufficient utilization of resources due to a low reaction efficiency.

Various techniques of thermal decomposition at relatively low temperatures in a reducing atmosphere for treating waste containing chlorine-containing polymers (and as a result which contains chlorine) are also known. Japanese Patent Application Laid-open (kokai) No. 48-67 discloses a method of indirect thermal decomposition treatment for waste or the like in a closed retort. Japanese Patent Application Laid-open (kokai) No. 49-78774, Japanese Patent Application Laid-open (kokai) No. 48-39572, and Japanese Patent Application Laid-open (kokai) No. 6-65582 disclose a technique of dechlorination treatment of chlorine-containing polymers in waste, attained by carrying out a first-stage thermal decomposition process at relatively low temperatures in a multi-stage thermal decomposition. Further, Japanese Patent Application Laid-open (kokai) No. 7-80433 discloses a treatment method which involves thermally decomposing vinyl chloride resin-containing dust into gases, oils, water, and solid residue at a temperature of 350° to 500° C. with oxygen being shut out as much as possible, and washing the generated gases and treating other elements which are generated so as to recycle them. The techniques described above, however, are for the purpose of to capturing a generated hydrogen chloride gas and carrying out an exhaust gas treatment such as washing neutralization as well as a secondary combustion treatment, and do not suppress the generation of a hydrogen chloride gas and dioxin.

SUMMARY OF THE INVENTION

In view of the present state of conventional techniques for incineration treatment for chlorine-containing waste, such as shredder dust, the inventors studied a treatment method which can suppress the generation of harmful gases such as hydrogen chloride and dioxin, which can greatly reduce the volume of waste, and which is advantageous in terms of reducing treatment costs, utilization of resources, and preservation of the environment. As a result, the inventors found that it is quite effective to thermally decompose or burn wastes in the presence of alkali metal oxides or alkaline earth metal oxides, at relatively low temperatures in a reducing atmosphere, and thus accomplished the present invention.

The present invention provides a volume-reducing treatment method for waste comprising the step of thermally decomposing or burning waste containing chlorine in the presence of alkali metal oxides or alkaline earth metal oxides, at a temperature of 300° to 1000° C. in a reducing atmosphere, where unburned carbon remains.

The present invention also provides a volume-reducing treatment method for waste, wherein part of the waste is thermally decomposed in advance in a waste feed passage to an incinerator while the supply of oxygen from outside is cut off.

The present invention further provides a volume-reducing treatment method for waste, wherein waste containing chlorine is previously sealed in a plastic container, and the sealed container is inserted into the waste feed passage.

The present invention further provides a volume-reducing treatment method for waste, wherein the plastic container is made of recycled plastics.

The present invention further provides a volume-reducing treatment method for waste, wherein a basic material containing alkali metal oxides or alkaline earth metal oxides is added to waste containing chlorine before the waste is thermally decomposed or burned.

The present invention further provides a volume-reducing treatment method for waste, wherein the basic material is red mud or alkali waste liquid.

The present invention further provides a volume-reducing treatment method for waste comprising using oxygen-rich air or oxygen gas as a combustion oxygen source and generating a combustible gas as a by-product.

The present invention further provides a volume-reducing treatment method for waste, wherein treated matter obtained by volume-reducing treatment is washed.

The present invention further provides a volume-reducing treatment method for waste, wherein waste containing chlorine is shredder dust.

In the volume-reducing treatment method for waste according to the present invention, waste is thermally decomposed or burned in the presence of alkali metal oxides or alkaline earth metal oxides at lower temperature than used in ordinary combustion and in a reducing atmosphere. As a result, chlorine contained in waste becomes inorganic chlorides, and the generation of harmful hydrogen chloride and dioxin is completely or considerably suppressed. When oxygen-rich air or oxygen gas is used as an oxygen source for use in treatment, a high-calorie combustible gas is obtained in the form of a combustion exhaust gas. By washing residue (treated matter) after thermal decomposition or combustion, the aforesaid inorganic chlorides can be easily removed. Thus washed residue, if disposed of, does not contaminate soil, or if dried, can be used as fuel. The treated matter which has been washed has a bigger bulk density as compared with waste before treatment and thus volume is greatly reduced. Further, inorganic chlorides are removed. The washed treated matter, therefore, is suited for disposal. When the treated matter is used as fuel, metal oxides or metals can be slagged.

In the volume-reducing treatment method for waste of the present invention, shredder dust and other waste which contains chlorine derived from chlorine-containing polymers such as a vinyl chloride resin and the like can be treated at a low cost. In the treatment, waste is thermally decomposed or burned in such a manner that the generation of hydrogen chloride and dioxin which damage the incinerator and are harmful to a human body is completely or considerably suppressed. Also, a combustible gas is obtained, whereby wastes can be recycled. Further, waste can be greatly reduced in volume, thereby considerably facilitating subsequent treatment and markedly reducing cost of disposal. And further, red mud and alkali waste liquid, which are industrial wastes, may be used as basic materials, whereby they can be disposed of together.

DESCRIPTION OF PREFERRED EMBODIMENTS

Waste which contains chlorine to which the present invention is applied includes waste containing chlorine-containing polymers such as shredder dust from discarded automobiles, waste household electric appliances and the like, of which shredder dust of discarded automobiles is preferred. However, waste to which the present invention is applied is not limited to the aforesaid types of waste, but may be industrial waste in a broad sense and also ordinary garbage or the like from offices and households. Vinyl chloride resins and polychloroprene rubber are given herein as examples of the aforesaid chlorine-containing polymers, but the chlorine-containing polymers are not to be limited thereto.

Taking shredder dust of discarded automobiles as waste to be treated, examples of a treating apparatus for use with the present invention will now be described with reference to FIGS. 1 and 2.

Figure 1:
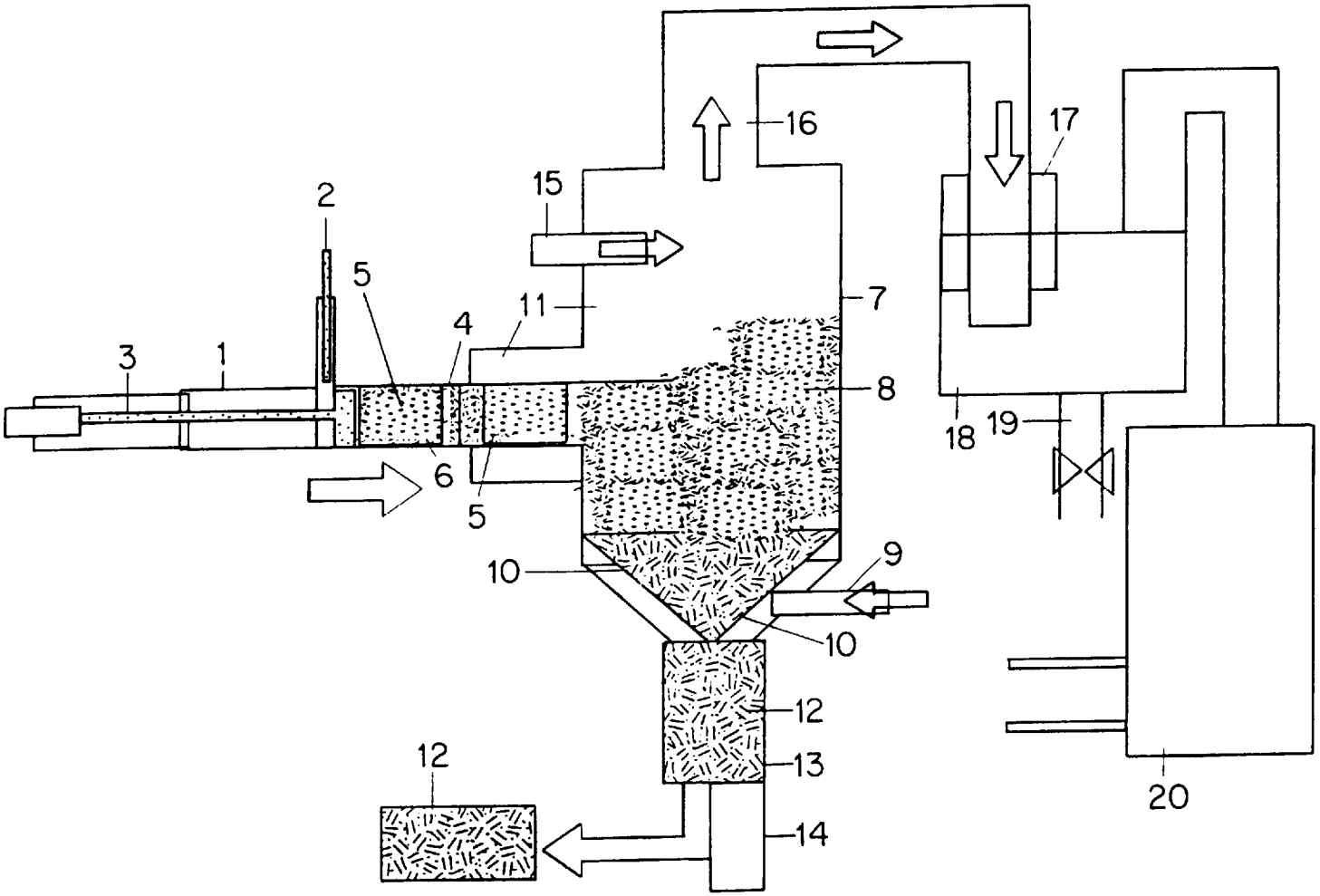
FIG. 1 is a schematic view showing an example of a treating apparatus for use with the present invention.

In FIG. 1, reference numeral 1 denotes a shredder dust charging port, reference numeral 2 denotes a charging port shutter, reference numeral 3 denotes a shredder dust container force piston, reference numeral 4 denotes a charging passage, reference numeral 5 denotes shredder dust, reference numeral 6 denotes a lidded plastic shredder dust container, reference numeral 7 denotes an incinerator, reference numeral 8 denotes thermally decomposing or burning shredder dust, reference numeral 9 denotes a main oxygen gas feed port, reference numeral 10 denotes a conical furnace bottom section formed of a board having holes for straightening fed oxygen gas flow, reference numeral 11 denotes a partial combustion/heating chamber located in the upper portion of the furnace, reference numeral 12 denotes treated matter, reference numeral 13 denotes a treated matter receiver, reference numeral 14 denotes a heavy oil drain port, reference numeral 15 denotes an auxiliary oxygen gas feed port, and reference numeral 16 denotes an exhaust gas exhaust port.

Further, exhaust gas treating equipment is composed of a cooling box (condenser) 17, a dehydrating chamber 18, a water drain port 19, and an exhaust gas holder 20.

The shredder dust 5 which is contained in the elastic lidded plastic container 6 is charged through charging port 1 and pushed into charging passage 4 by force piston 3. As shown in FIG. 1, charging passage 4 projects outside incinerator 7. Accordingly, at the stage where a container is being pushed into the projecting portion, the container and its shredder dust 5 are at a normal temperature. However, as the container and shredder dust 5 approach an internal portion of incinerator 7, the temperature thereof increases. Thus, container 6 itself gradually softens and closely contacts the inner surface of charging passage 4, whereby charging passage 4 can be held hermetic against the outside air. While the container is holding the charging passage hermetic, shredder dust 5 partially undergoes thermal decomposition. Gas generated by the thermal decomposition prevents an oxygen-containing gas from flowing into the charging passage from the inside of the incinerator, whereby a reducing atmosphere can be maintained in the charging and transferring section. The heated portion of the charging passage is preferably long enough to allow the shredder dust to partially undergo thermal decomposition as described above.

Since a low-grade recycled product of waste plastics can be used as container 6, plastic wastes can be effectively utilized, and the volume thereof can be reduced.

The container filled with shredder dust 5 is pushed deep into charging passage 4 by force piston 3, partially undergoes thermal decomposition as described above, and then drops into the lower portion of incinerator 7. In the lower portion of the incinerator 7, the shredder dust, together with the container, undergoes thermal decomposition or combustion. The lower portion of incinerator 7 comprises conical furnace bottom section 10 formed of a board having holes for straightening fed oxygen gas flow. An oxygen gas fed through main oxygen gas feed port 9 is fed into the incinerator via board 10 having holes for straightening fed oxygen gas flow. When the thermal decomposition or burning of the shredder dust is not maintained, auxiliary burners (not shown) provided in conical furnace bottom section 10 can be used so as to maintain thermal decomposition or combustion. A combustible gas, described later, which is obtained by treatment according to the present invention, can be used as a fuel of combustion for the auxiliary burners. However, another fuel source may be used.

Shredder dust 5 which has dropped in the lower portion of the incinerator is burned or thermally decomposed in a reducing atmosphere so as to allow unburned carbon to remain and at a temperature of 300° to 1000° C., preferably 500° to 700° C. The flow rate of the oxygen gas fed through the main oxygen gas feed port or combustion in the partial combustion/heating chamber is controlled so as to maintain the combustion or thermal decomposition. In ordinary combustion where unburned carbon does not remain, the shredder dust burns at a temperature of over 1000° C. As a result, hydrogen chloride gas and dioxin are generated from chlorine-containing polymers which are contained in the shredder dust. According to the present invention, however, hydrogen chloride gas is hardly generated at all because combustion is carried out at a relatively low temperature of not more than 1000° C. and in a reducing atmosphere.

Using oxygen gas fed through auxiliary oxygen gas feed port 15 in the upper portion of incinerator 7, part of the combustible exhaust gas which is generated by the thermal decomposition or burning of the shredder dust to ascend is burned in the partial combustion/heating chamber located in the upper portion of the furnace. Thus generated radiant heat can be used to maintain a temperature of 300° to 1000° C. in the lower portion of the incinerator at which the shredder dust is thermally decomposed or burned. Since an oxidative exhaust gas generated as a result of combustion ascends in the furnace, only radiant heat is utilized as a heat source. Accordingly, the oxidative gas and unburned waste do not contact, so unburned waste is not subjected to unnecessary oxidation. Thus, thermal transfer and mass transfer can be separated. Further, when the shredder dust contains much water, the incinerator itself may be heated from outside (not shown). In this case, a combustible exhaust gas, described later, may be used as a heating fuel source. The flow rate of oxygen gas fed through auxiliary oxygen gas feed port 15 may be limited to the minimum required for maintaining the aforesaid temperature range of combustion or thermal decomposition. Unlike ordinary combustion in an oxidative atmosphere, the combustible exhaust gas hardly contains hydrogen chloride and the like. Thus, even when part of the combustible exhaust gas is burned in the upper portion of the furnace, dioxin is not generated.

The treated matter 12, i.e. the shredder dust whose volume has been reduced by thermal decomposition or burning, drops from conical furnace bottom section 10 into treated matter receiver 13. Treated matter 12 is cooled in treated matter receiver 13 and then removed therefrom. The combustion exhaust gas generated in the thermal decomposition or burning of the shredder dust is a high-calorie combustible gas composed of carbon monoxide, hydrocarbon, water vapor, carbon dioxide and the like, and is removed from the furnace through exhaust port 16. Heavy oil (higher hydrocarbons) generated in the thermal decomposition or burning of the shredder dust is drained from the furnace through drain port 14.

In place of the aforesaid oxygen gas, which is fed through the main oxygen gas feed port and the auxiliary oxygen gas feed port, oxygen-rich air or air can be used. However, when oxygen-rich air having a higher nitrogen content or ordinary air is used, the exhaust gas contains nitrogen with a resultant deterioration in quality thereof. Oxygen density, therefore, should be 50% or higher, preferably 90% or higher. Oxygen gas or oxygen-rich air having a desirable oxygen density can be produced by the pressure swing adsorption method (PSA) or by an air liquefying separator which uses the aforesaid combustible exhaust gas as a power fuel source.

Shredder dust 5 to be treated in the system shown in FIG. 1 usually contains alkali metal oxides and alkaline earth metal oxides in the form of glass pieces or the like. When their content is low, hydrogen chloride and dioxin are likely to be generated in thermal decomposition or combustion. It is therefore preferable that a basic material containing alkali metal oxides or alkaline earth metal oxides be added to the shredder dust 5 in advance. The basic material is preferably red mud which is released in large quantities as industrial waste, or alkali waste liquid from plating plants or the like. This has an advantage that these industrial wastes can be treated together. The basic material containing water can be used as is, but preferably, it is dehydrated for use.

Treated matter 12, i.e. the shredder dust which has been treated as described above and removed from the furnace, is greatly reduced in volume as compared with the untreated shredder dust. Accordingly, treated matter 12 may be disposed of in scrap yards or the like. However, since treated matter 12 contains metal oxides, metals, unburned carbon, chlorine salts of alkali metals and alkaline earth metals and the like, treated matter 12 is preferably washed so as to remove soluble chlorine salts, heavy metal salts and the like before it is disposed of in scrap yards. This is good for environmental preservation. Even more preferably, washed treated matter 12 is air-dried or dried by using the aforesaid combustible exhaust gas as a drying fuel, and thus dried treated matter 12 is used again as fuel. Since chlorine salts and the like are already removed from treated matter 12 by washing, burning treated matter 12 does not involve generating hydrogen chloride and the like and provides further reduction in volume. After burning treated matter 12, there remains primarily slag of metal oxides and metals.

Figure 2:
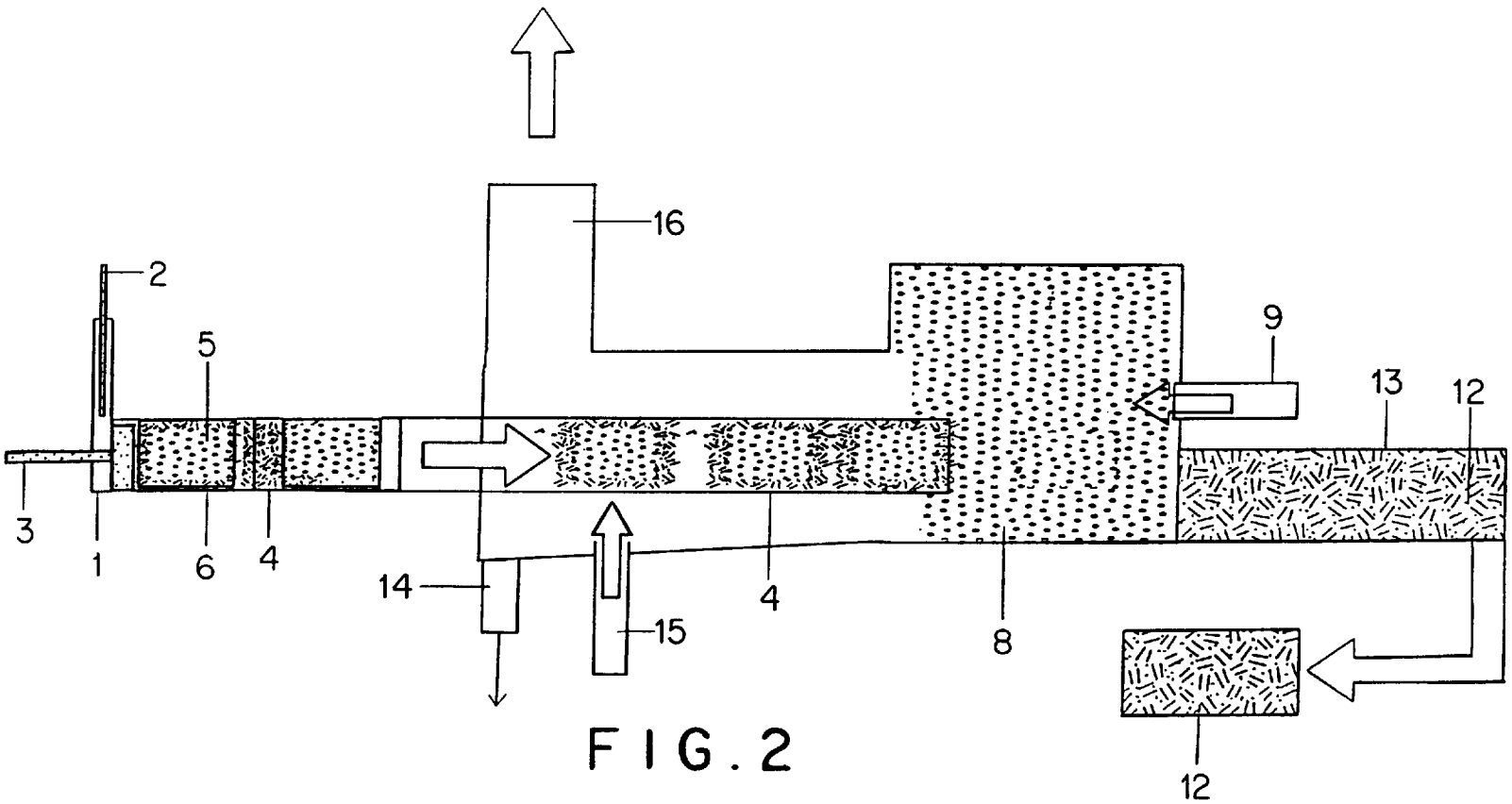
FIG. 2 is a schematic view showing an example of another treating apparatus for use with the present invention.

In contrast with the vertical incinerator of FIG. 1, FIG. 2 schematically shows a horizontal incinerator. In FIG. 2, reference numerals used in common with FIG. 1 denote apparatus features which carry out the same or similar functions. In FIG. 2, unlike FIG. 1, shredder dust charging passage 4 extends longer in the furnace, so that thermal decomposition advances while the shredder dust is passing through the passage. Passage 4, which is a thermal decomposition section, is separated from the secondary combustion section (outside the passage). Accordingly, while a reducing atmosphere is maintained within passage 4, a thermal decomposition temperature can be raised as needed. A thermal transfer is carried out through the wall of passage 4, thereby separating a thermal transfer from a mass transfer and preventing an oxidative exhaust gas from entering passage 4, which is a thermal decomposition section. In FIG. 2, shredder dust containers 6 in charging passage 4 are schematically illustrated. Preferably, containers 6 are charged into charging passage 4 without leaving a clearance therebetween, whereby the charging passage is hermetically maintained from the outside air. Oxygen gas fed through the main oxygen gas feed port is dispersed, whereby the fed oxygen gas is prevented from passing through and being discharged from the furnace without being used in burning or thermally decomposing the shredder dust (a board having holes for straightening the flow of the fed main oxygen gas is not shown in FIG. 2).

Embodiments of the present invention will now be specifically described by way of example. The present invention, however, is not to be limited to the embodiments.

Embodiment 1

A volume-reducing treatment test was carried out on shredder dust having compositions shown in Tables 1 to 4, in a small incinerator having a structure shown in FIG. 1 and a volume of 1.0 $m^3$. The shredder dust was filled into an elastic plastic container and charged into the incinerator at 10 kg/H while holding the passage hermetic. In the lower portion (combustion chamber) of the incinerator, the charged shredder dust was gradually heated from 25° C. to a thermal decomposition temperature of about 500° C. Solid matter which was left after thermally decomposing the shredder dust was allowed to drop downward. Generated gas was allowed to ascend to the upper portion of the incinerator. Part of the gas underwent partial combustion with oxygen gas which was fed at 0.14 $m^3$/H (25° C.), whereby the temperature of the combustion chamber was maintained by means of external heat. The flow rate of an exhaust gas from the upper portion of the incinerator 7 was 6.7 $m^3$/H (25° C.). The chemical composition of the exhaust gas was as listed in Table 5. The composition of residual solid matter was as listed in Table 6. In the present experiment, sufficient heat generation was obtained without supplying oxygen for oxidization, and thus oxygen for oxidization was not supplied through the main oxygen gas feed port.

TABLE 1

General composition of shredder dust

| Main components | Weight % |
|---|---|
| Plastics | 28 |
| Rubber | 27 |
| Glass | 14 |
| Electric wires | 3 |
| Ligneous | 2 |
| Metals | 8 |
| Water | 10 |
| Others | 8 |

TABLE 2

Breakdown of plastics

| Plastics | Weight % |
|---|---|
| Polypropylene | 22 |
| ABS resin | 20 |
| Soft polyurethane | 13 |
| Polystyrene | 12 |
| Vinyl chloride resin | 13 |
| Polyethylene | 8 |
| Hard polyurethane | 3 |
| Acrylic resin | 2 |
| Urea resin | 1 |
| Others | 6 |

TABLE 3

Breakdown of metals

| Metals | Weight % |
|---|---|
| Iron | 30 |
| Copper | 60 |
| Zinc | 5 |
| Cadmium | 0.01 |
| Others | 5 |

TABLE 4

Breakdown of glass sand

| Components | Weight % |
|---|---|
| $SiO_2$ | 40 |
| $Al_2O_3$ | 12 |
| MgO | 10 |
| CaO | 34 |
| $K_2O$ | 0.3 |
| $Na_2O_3$ | 1.5 |
| $TiO_2$ | 2 |

Embodiment 2

Test conditions were identical to those of embodiment 1 except that thermal decomposition temperature was 750° C. The flow rate of the exhaust gas was 10.5 $m^3$/H (25° C.). Results of analysis of the generated gas and residual solid matter are listed in Tables 5 and 6.

Embodiment 3

Test conditions were identical to those of embodiment 1 except that thermal decomposition temperature was 500° C. and that red mud which had been dehydrated at 120° C. for two hours was fed at 6.6 kg/H (0.9 kg/H in sodium hydroxide) with the shredder dust. The flow rate of the exhaust gas was 7.2 $m^3$/H (25° C.). Results of analysis of the generated gas and residual solid matter are listed in Tables 5 and 6.

TABLE 5

Residual solid matter

| | | Embodiment 1 | Embodiment 2 | Embodiment 3 |
|---|---|---|---|---|
| Yield (kg/H) | | 6.0 | 6.1 | 6.6 |
| Major components (weight %) | C | 65 | 64 | 55 |
| | $CaCO_3$ | 18 | 16 | 14 |
| | Cu | 10 | 10 | 9 |
| | FeO | 3 | 3 | 1.8 |
| | Fe | 3 | 2 | 3 |
| | ZnO | 0.9 | 0.9 | 3 |
| | NaCl | 0.9 | 0.9 | $CaCl_2$ 0.6 |

TABLE 6

Results of quantitative analysis of exhaust gas from incinerator

| | | Embodiment 1 | Embodiment 2 | Embodiment 3 |
|---|---|---|---|---|
| Exhaust gas flow rate ($m^3$/H, 25° C.) | | 6.7 | 10.5 | 7.2 |
| Components (volume %) | $H_2$ | 44 | 44 | 53 |
| | $CH_4$ | 36 | 36 | 44 |
| | N2 | 6 | 6 | 14 |

TABLE 6-continued

| Results of quantitative analysis of exhaust gas from incinerator | | | |
|---|---|---|---|
| | Embodiment 1 | Embodiment 2 | Embodiment 3 |
| $CO_2$ | 2 | 2 | 1.3 |
| CO | 0.9 | 1 | 0.6 |
| HCl | 0.2 | 0.3 | 0.003 |

Test results

As seen from the above test results, the lower the thermal decomposition temperature is, the less hydrogen chloride is generated. However, in view of the equilibrium of the thermal decomposition temperature and the reaction rate, it is preferable that the thermal decomposition temperature fall in a range of 500° to 750° C. Also, even when red mud (soda-containing matter) was not added, the generation of hydrogen chloride was as low as about 0.3%. As a result of adding red mud, the generation of hydrogen chloride and other chlorine-containing compounds was quite low. Particularly, in Embodiment 3, the generation of hydrogen chloride was 30 ppm, and even an occasional drop below 30 ppm was observed during the test. The generated gas is found to be a high-calorie gas which is mainly composed of hydrogen and methane.

What is claimed is:

1. A volume-reducing treatment method for waste comprising the step of thermally decomposing or burning waste containing chlorine in the presence of alkali metal oxides or alkaline earth metal oxides at a temperature of 300°–1000° C. in a reducing atmosphere to produce solid matter in which unburned carbon remains, wherein said solid matter comprises at least 55 wt. % carbon.

2. The method according to claim 1, wherein part of the waste is thermally decomposed in advance in a waste feed passage to an incinerator while the supply of oxygen from outside is cut off.

3. The method according to claim 2, wherein waste containing chlorine is previously sealed in a plastic container, and that the sealed container is inserted into the waste feed passage.

4. The method according to claim 3, wherein the plastic container is made of recycled plastics.

5. The method according to claim 1, wherein a basic material containing alkali metal oxides or alkaline earth metal oxides is added to waste containing chlorine before the waste is thermally decomposed or burned.

6. The method according to claim 5, wherein the basic material is red mud or alkali waste liquid.

7. The method according to claim 1, wherein oxygen-rich air or oxygen gas is used as a combustion oxygen source to produce a combustible gas as a by-product.

8. The method according to claim 1, further comprising a washing step for said solid matter.

9. The method according to claim 1, wherein the waste containing chlorine is waste containing a chlorine-containing polymer.

10. The method according to claim 1, wherein the waste containing chlorine is shredder dust.

11. The method of claim 1, wherein said alkali metal oxides or alkaline earth metal oxides is sodium hydroxide.

12. A volume-reducing treatment method, comprising:

heating a composition containing chlorine at 300°–1,000° C., to produce a solid residue;

wherein said composition comprises a first compound containing oxygen and a metal selected from the group consisting of alkali metals and alkaline earth metals, said solid residue comprises carbon and a second compound containing chlorine and said metal, and said solid residue comprises at least 55 wt. % carbon.

13. The method of claim 12, further comprising, prior to said heating, thermally decomposing said composition in a waste feed passage.

14. The method of claim 12, wherein said composition is prepared by mixing a waste containing chlorine with a material containing said first compound.

15. The method of claim 14, wherein said material comprises a member selected from the group consisting of red mud and alkali waste liquid.

16. The method of claim 12, wherein said heating produces said solid residue, methane and hydrogen.

17. The method of claim 12, further comprising washing said solid residue to remove said second compound.

18. The method of claim 12, wherein said composition comprises shredder dust.

19. The method of claim 12, wherein said chlorine contained in said composition is present as a chlorine-containing polymer.

* * * * *

UNITED STATES PATENT AND TRADEMARK OFFICE

CERTIFICATE OF CORRECTION

PATENT NO. : 5,890,443

DATED : April 6, 1999

INVENTOR(S): Sadao TAYA, et al.

It is certified that an error appears in the above-identified patent and that said Letters Patent is hereby corrected as shown below:

On the title page, item [30] is missing. It should be:

--[30] Foreign Application Priority Data

Nov. 29, 1994 [JP] Japan ..... 6-319317--

Signed and Sealed this

Twenty-first Day of March, 2000

*Attest:*

Q. TODD DICKINSON

*Attesting Officer*

*Commissioner of Patents and Trademarks*